United States Patent [19]

Baker et al.

[11] Patent Number: 4,521,229

[45] Date of Patent: Jun. 4, 1985

[54] TUBULAR DISCHARGE ELECTRODE FOR ELECTROSTATIC PRECIPITATOR

[75] Inventors: Robert D. Baker, Vincent; Gerald W. Driggers, Cropwell; Ronald W. Gray; Lawrence A. Hawkins, both of Birmingham, all of Ala.

[73] Assignee: Combustion Engineering, Inc., Windsor, Conn.

[21] Appl. No.: 547,802

[22] Filed: Nov. 1, 1983

[51] Int. Cl.[3] ..... B03C 3/08; B03C 3/41

[52] U.S. Cl. ..... 55/137; 55/152; 55/154; 361/226; 361/230

[58] Field of Search ..... 55/150–152, 55/154, 137, 128, 129; 361/222, 226, 230

[56] References Cited

U.S. PATENT DOCUMENTS

| | | | |
|---|---|---|---|
| 1,343,285 | 6/1920 | Schmidt | 55/137 X |
| 2,195,431 | 4/1940 | Shively et al. | 55/150 X |
| 3,740,925 | 6/1973 | Gothard | 55/129 X |
| 4,106,919 | 8/1978 | Lagerdahl | 55/150 X |
| 4,126,434 | 11/1978 | Keiichi | 55/152 X |
| 4,303,418 | 12/1981 | Coe, Jr. | 55/152 X |
| 4,326,861 | 4/1982 | Matsumoto | 55/152 X |
| 4,375,364 | 3/1983 | Van Hoesen et al. | 55/152 |
| 4,412,850 | 11/1983 | Kurata et al. | 55/152 X |

FOREIGN PATENT DOCUMENTS

| | | | |
|---|---|---|---|
| 299476 | 7/1917 | Fed. Rep. of Germany | 55/152 |
| 2018447 | 11/1971 | Fed. Rep. of Germany | 55/152 |
| 706129 | 12/1979 | U.S.S.R. | 55/152 |

*Primary Examiner*—Kathleen J. Prunner
*Attorney, Agent, or Firm*—William W. Habelt

[57] ABSTRACT

An electrostatic precipitator (10) having a casing (12) defining a precipitation chamber (6) wherein a plurality of discharge electrode subassemblies (32) are disposed alternately between a plurality of collecting electrode plates (20). Each discharge electrode subassembly (32) is comprised of a plurality of individual tubular discharge electrodes (50) extending vertically between support frame members. Each tubular discharge electrode (50) is comprised of a vertically elongated tubular member (54) having an elliptical cross-section disposed with the longer axis of the ellipse perpendicular to the collecting electrode plates and the shorter axis of the ellipse parallel to the collecting electrode plates. A plurality of corona discharge pins (52) are disposed along the length of the discharge electrodes at spaced intervals and extend outwardly from the longitudinal axis of the tubular member (54) at an acute angle preferably in the range of at least 45 degrees to not more than 60 degrees.

6 Claims, 6 Drawing Figures

TUBULAR DISCHARGE ELECTRODE FOR ELECTROSTATIC PRECIPITATOR

BACKGROUND OF THE INVENTION

The present invention relates to electrostatic precipitators and, more particularly, to a tubular discharge electrode and discharge electrode assembly for electrostatic precipitators which by design has inherent structural integrity and develops an improved electrostatic field profile.

In the operation of an electrostatic precipitator, a gas laden with entrained particulate material is passed through an electrostatic field established about a discharge electrode disposed between two grounded collecting electrodes. The suspended particles become electrically charged as they pass through the electrostatic field and move to, under the electrostatic field, and deposit upon the grounded collecting electrodes flanking the discharge electrode. Each collecting electrode is typically formed of one or more elongated plates disposed and suspended from the top of the precipitator housing in a vertical plane. A plurality of such collecting electrodes are disposed transversely across the precipitator casing in spaced vertical planes parallel to the direction of gas flow through the precipitator.

In the most common electrostatic precipitators, referred to as rigid frame electrostatic precipitators, a box-like framework comprised of a plurality of discharge electrode frames mounted in a framework which is suspended from insulators at the top of the precipitator housing to provide a row of vertically disposed discharge electrodes between adjacent collecting electrodes across the width of the precipitator. The voltage is applied to the discharge electrodes to generate the electrostatic field. Each discharge electrode frame is comprised of a plurality of individual flexible discharge electrode wires tautly strung across the support frame.

As electrode wires are installed at ambient temperatures but operated at temperatures in the range of 150 C. to 250 C., the discharge electrode wires may elongate due to thermal expansion and therefore become loose. Discharge electrode wires may also become loose due to handling during erection and shipment of the discharge electrode frames. Although a loose wire will not impede the dust collection process per se, a loose discharge electrode wire may not clean as well in the rapping process.

Furthermore, flexible discharge electrode wires are structurally weak and may break under the tensioning required to keep them taut and repeated fatigue of rapping and thermal cycling. If a discharge electrode wire does break, it may be moved by the gas flow into contact with the collecting electrode causing shorting of the precipitator and necessitating removal of the precipitator from service.

SUMMARY OF THE INVENTION

It is, therefore, an object of the present invention to provide a discharge electrode having inherent structural integrity while at the same time producing a satisfactory electrostatic field and corona current to the collecting electrode plates.

In accordance with the present invention, an electrostatic precipitator is provided comprising a housing defining a precipitation chamber therein through which a horizontal flow of gas to be cleaned is passed, a collecting electrode assembly comprised of a plurality of collecting electrode plates disposed within the precipitation chamber in spaced vertical planes parallel to the direction of gas flow therethrough, and a discharge electrode assembly to which a voltage is applied to generate an electrostatic field comprised of a plurality of discharge electrode subassemblies disposed parallel to and alternately intermediate between collecting electrode plates, each subassembly supporting a plurality of spaced vertically extending rigid tubular discharge electrodes having an ellipsoidal configuration in transverse cross-section.

The tubular discharge electrode of the present invention comprises an elongated hollow tube extending along a vertically disposed longitudinal axis and having a transverse cross-section having an ellipsoidal configuration. A plurality of corona discharge pins are disposed at spaced intervals along the length of the hollow tube of the tubular discharge electrode and extend outwardly therefrom in a plane parallel to the collecting electrode plate. Each of the tubular discharge electrodes are disposed with the longer axis of the ellipsoidal cross-section thereof perpendicular to the collecting electrode plates and the shorter axis of the ellipsoidal cross-section thereof parallel to the collecting electrode plate.

Preferably, the corona discharge pins extend outwardly from the tubular discharge electrodes at an acute angle with the longitudinal axis of the tubular discharge electrode at an angle of at least 45 degrees and most preferably, in the range from at least 45 degrees to not more than 60 degrees. Additionally, it is preferred that the corona discharge pins extend outwardly and also downwardly from the tubular discharge electrode at an acute angle with the longitudinal axis thereof of at least 45 degrees and not more than 60 degrees.

BRIEF DESCRIPTION OF THE DRAWINGS

The present invention will be better understood and the above and other objects of the present invention will become more apparent and appreciated when viewed in light of the following description of a preferred embodiment with reference to the accompanying drawings wherein.

DESCRIPTION OF THE PREFERRED EMBODIMENT

Figure 1:
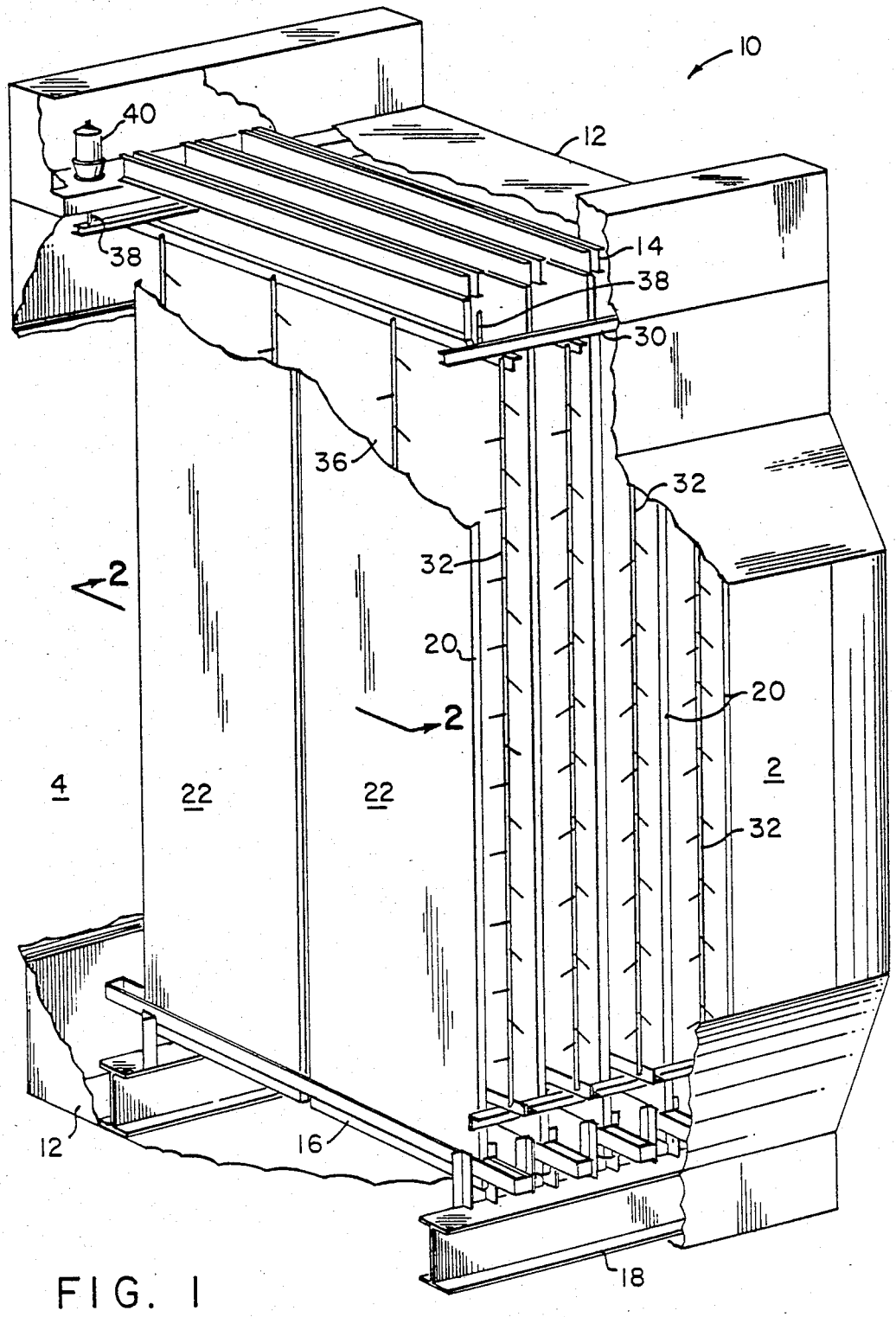
FIG. 1 is a perspective view, partly in section, of an electrostatic precipitator incorporating the tubular discharge electrode of the present invention.
Figure 2:
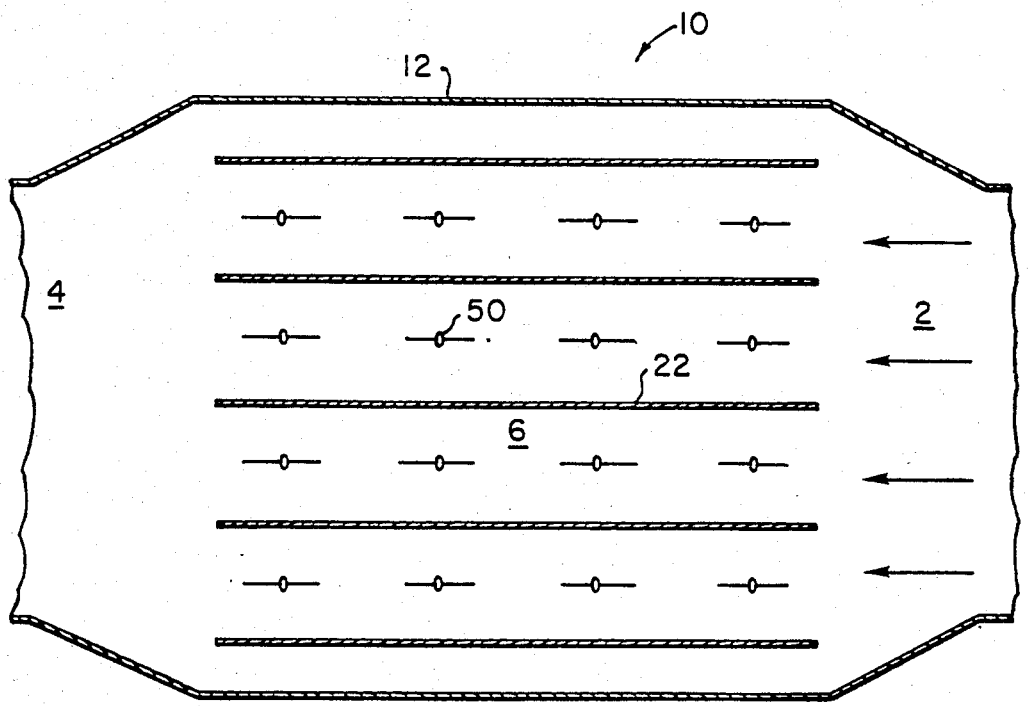
FIG. 2 is a sectional plan view taken along line 2—2 of FIG. 1.

Referring now to the drawing, and most particularly to FIGS. 1 and 2 thereof, there is depicted therein an electrostatic precipitator 10 having a casing 12 with an inlet 2 and an outlet 4 and a precipitation chamber 6 disposed therebetween. The particulate laden flue gas to be cleaned passes through the housing 12 of the precipitator 10 passing from the gas inlet 2 through the precipitation chamber 6 and out the gas outlet 4 as a clean, relatively particulate free gas.

The basic configuration of the precipitator 10 is well known in the art, and is typically referred to as a rigid discharge electrode type electrostatic precipitator. A plurality of substantially rectangular collecting electrode plates 22, forming collectively a collecting electrode plate assembly 20, are disposed in substantially parallel, spaced relationship in vertical planes within the precipitation chamber 6. Interdisposed in the spaces between the collecting electrode plates 22 are a plurality of discharge electrode subassemblies 32 which collectively form a discharge electrode assembly 30. Both the collecting electrode plates 22 and the discharge electrode subassemblies 32 are aligned parallel to and extend in the direction of the gas flow through the precipitation chamber 6 from the inlet 2 to the outlet 4 thereof.

Each collecting electrode plate 22 is suspended and supported from upper support beams 14 disposed across the precipitation chamber 6. The lower end of each of the suspended electrode plates 22 is laterally constrained from movement by inserting it into a guide member 16 which is mounted to the lower support beams 18 disposed in the bottom of the precipitation chamber. Thus, the suspended collecting electrode plates, which may range anywhere from 12 to 50 feet in height, are free to move vertically downward within the guide members 16 due to temperature effects but are constrained from any. lateral movement by guide members 16.

The collecting electrode plates 22 are shown in the drawing as being of a particular cross-section merely for purposes of illustration and not limitation. It is to be understood that the present invention contemplates utilizing collecting electrode plates of any of a number of cross-sectional design with the particular design utilized in any given situation being selected on an individual basis to give optimal precipitation efficiency and a quiescent zone at the surfaces of the collecting electrode plates 22.

Figure 3:
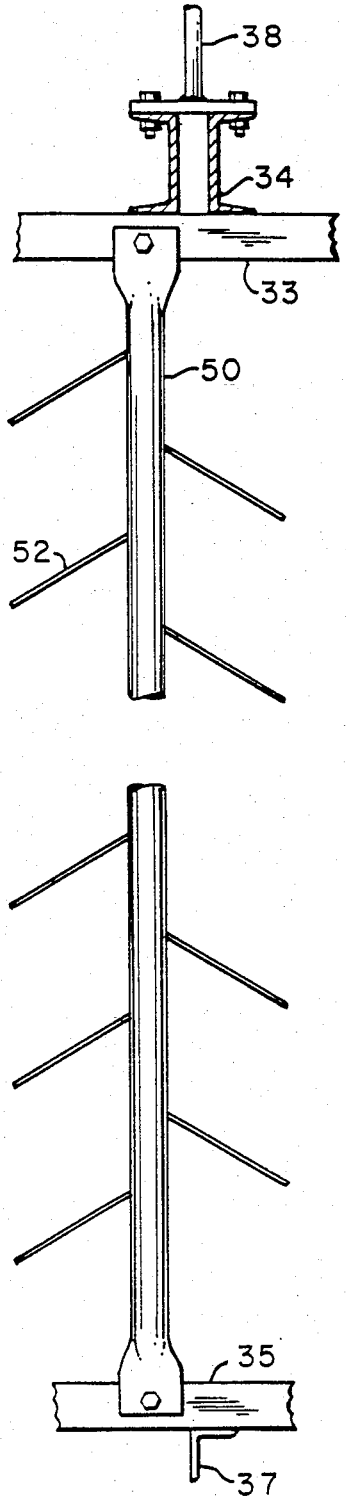
FIG. 3 is a side elevational view of a single tubular discharge electrode of the present invention showing the mounting of the tubular discharge electrode to the discharge electrode support and alignment members.
Figure 4:
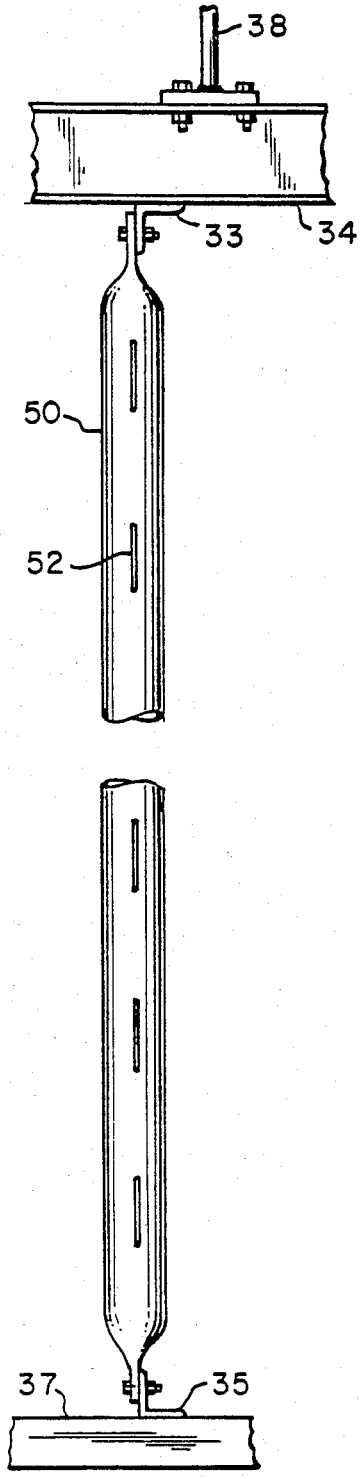
FIG. 4 is an end elevational view of a single tubular discharge electrode of the present invention showing the mounting of the tubular discharge electrode to the discharge electrode support and alignment members.

The individual discharge electrode subassemblies 32 collectively and in conjunction with support bar 34 from which the individual discharge electrode subassemblies 32 are supported, form a discharge electrode assembly 30 which is suspended from the top of the precipitation chamber 6 and mounted to the casing 12 through insulators 40. Each of the individual discharge electrode subassemblies 32 is formed of a plurality of individual tubular discharge electrodes 50 disposed at spaced intervals to extend transversely between and be mounted to an upper frame member 33 and a lower frame member 35 as best seen in FIGS. 3 and 4. Support bars 34 from which the individual discharge electrode assemblies 32 are supported extend transversely across the inlet and the outlet of the precipitation chamber 6 in the upper region of the housing 12 and are suspended by support rods 38 from the insulators 40 mounted to the casing 12. The upper frame members 33 of each of the discharge electrode subassemblies 32 are mounted to the support beams 34 to extend transversely therebetween such that a plurality of discharge electrodes are suspended between each pair of collecting electrode plates 20 in a vertical plane equidistant therebetween. Additionally, the lower frame member 35 of each discharge electrode subassemblies 32 is mounted to a pair of lower support beams 37 which extend transversely across the precipitation chamber 6 to add additional structural rigidity to the discharge electrode assembly 30.

In operation, a particulate laden gas enters the precipitator casing 12 through the inlet 2 thereof and flows through the precipitation chamber 6 to the outlet 4 thereof. In traversing the precipitation chamber 6, the particulate laden gas flows between the spaced collecting electrode plate assemblies 20 and over the discharge electrode subassemblies 32 suspended therebetween. An electrical charge is applied to each of the discharge electrode subassemblies 32 so as to establish an electrostatic field extending between the discharge electrode subassembly and the grounded collecting electrode plates 22. As the particulates within the gas pass through the precipitation chamber 6, the particulates are ionized and migrate to and deposit upon the collecting electrode plates 22.

Figure 5:
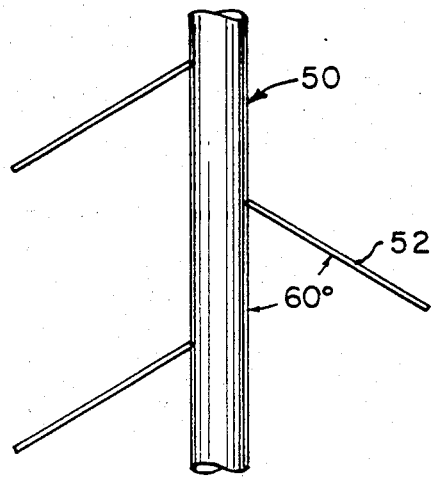
FIG. 5 is an enlarged side elevational view of the tubular discharge electrode of the present invention showing the details of the relationship of the corona pins to the tubular member of the tubular discharge electrode.
Figure 6:
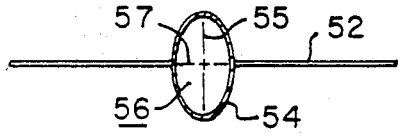
FIG. 6 is a cross-sectional view of the tubular discharge electrode of FIG. 5 showing the ellipsoidal cross-section thereof.

In accordance with the present invention, the spaced vertically extending discharge members 50 of each of the discharge electrode subassemblies 32 is comprised on an elongated hollow tubular member 54 extending along a vertically disposed longitudinal axis and having a transverse cross-section 56 having an ellipsoidal configuration, and a plurality of corona discharge pins 52 disposed at spaced intervals along the length of the hollow tubular member 54 and extending outwardly therefrom as best seen in FIGS. 5 and 6. The tubular discharge electrode members 50 are disposed within the discharge electrode subassembly 32 with the longer axis 55 of the ellipsoidal cross-section 56 of the tubular members 54 disposed perpendicular to the plane of the discharge electrode subassembly 32 and with the shorter axis 57 of the ellipsoidal cross-section 56 of the tubular member 54 being parallel to the plane of the collecting electrode 22. The corona discharge pins 52 are mounted to the tubular member 54 at spaced intervals along the length thereof so as to extend outwardly therefrom in the plane of the collecting electrode 22.

Thus, when the discharge electrode subassemblies 32 are disposed in vertical planes parallel to and intermediate between collecting electrode plates 22, the longer axis 55 of the ellipsoidal cross-section 56 of each of the individual tubular discharge electrodes 50 is disposed perpendicular to the collecting electrode plates 22 and the shorter axis 57 of the ellipsoidal cross-section 56 of each of the tubular discharge electrodes 50 is disposed parallel to the collecting electrode plates. This disposition of the elliptical discharge electrode tube 54 serves to inherently increase the resistance of the discharge electrode to bowing towards the collecting electrode plates.

Because of the attraction forces between the collecting electrode plates 22 and the discharge electrode subassemblies 32 disposed therebetween due to their different electrical charges, there is a tendency for discharge electrodes to bow towards one of the adjacent collecting electrode plates, particularly if the discharge electrode is even slightly displaced from a central location between the two neighboring collecting electrode plates. Applicants have found that by forming the discharge electrode 50 of an elongated tubular member 54 having an elliptical transverse cross-section 56 and disposing the ellipical tubular discharge electrode between the collecting electrode plate assemblies 20 with the longer axis 55 of the elliptical tubular member 54 perpendicular to the collecting electrode plates and the shorter axis 57 thereof parallel to the collecting electrode plates that the tubular discharge electrode 50 will have a greater resistance to this tendency of bowing toward the collecting electrode plates than would tubular discharge electrodes having a round or square transverse cross-section of similar cross-sectional area or elliptical tubular discharge electrodes disposed with their shorter axis perpendicular to and their longer axis parallel to the collecting electrode plates. Additionally, it has been found that an elliptical tubular discharge electrode exhibits somewhat more favorable electrostatic field generation characteristics than similar tubular discharge electrodes having a round or square transverse cross-section.

In accordance with the present invention, the corona discharge pins 52 extend outwardly from the elliptical tubular member 54 along a plane through the shorter axis 57 of the elliptical tubular member 54 at an acute angle with the longitudinal axis thereof of at least 45 degrees, and preferably not more than 60 degrees. Additionally, although the corona discharge pins 52 may extend outwardly and downwardly at an acute angle with respect to the longitudinal axis of the tubular member 54 along one side thereof and outwardly and upwardly at an acute angle from the longitudinal axis of the tubular member 54 along the other side thereof, it is preferred that the corona discharge pins 52 extend outwardly in the same vertical direction from both sides of the tubular member 54, and preferably outwardly and downwardly at an acute angle from both sides of the tubular member 54. The downward angle enhances the ease of removal of collected dust and impedes such collection on the corona pins.

The acute angle at which the corona discharge pins 52 extend outwardly with respect to the longitudinal axis of the elongated elliptical tubular member 54 is very important to performance. The angle must be chosen to provide an optimal exposure of the particles entrained in the gas flowing through the precipitation chamber 6 to the electrostatic field established about the corona discharge pins 52. The electrostatic field generated about each of the corona discharge pins 52 is in the form of an expanding cyinder expanding outwardly from the longitudinal axis of the corona discharge pins with the strength of the electrostatic field decreasing in the radially outward direction. If the corona discharge pins were to extend perpendicularly outward with respect to the vertically disposed longitudinal axis of the tubular member 54, the corona discharge pins would be parallel to the gas flow through the precipitation chamber 6. In that case, the particles in the gas flow which passed over the discharge electrode 50 through the interval between the spaced corona discharge pins 52 would be exposed to a weak portion of the electrostatic field while those particles which passed over the discharge electrode 50 in the immediate vicinity of the corona discharge pins would be exposed to a strong electrostatic field. If the acute angle at which the corona discharge pins 52 extend outwardly with respect to the longitudinal axis of the tubular member 54 were too small, the corona discharge pins would be extending nearly perpendicular to the gas flow through the precipitation chamber 6 and therefore the particles would be exposed to the electrostatic field for a shortened period of time.

Applicants have found that maximum exposure of particles in the gas flow through the precipitation chamber 6 to the electrostatic field is obtained when the corona discharge pins extend from the tubular member 54, outwardly with respect to the longitudinal axis thereof at an acute angle in the range of 45 to 60 degrees. Thus, the electrostatic field generated about the corona discharge pins 52 will extend outwardly as an expanding cylinder about a longitudinal axis being at an angle in the range from at least 45 to not more than 60 degrees with the vertical. The particles entrained in the gas flowing horizontally through the precipitation chamber 6 will pass through the electrostatic field generated about the corona discharge points at a skew. Thus, each particle will be exposed to the electrostatic field for a longer period of time and also will be exposed to a strong electrostatic field for at least a portion of the time that it is exposed to the electrostatic field generated about the corona discharge pins 52.

Additionally, the corona discharge pins 52 extend outwardly from the tubular member 54 in the plane of the shorter axis 57 of the tubular discharge member 54. Therefore, when the discharge electrode subassemblies 32 are positioned within the precipitation chamber 6 equidistant between two adjacent collecting electrode plate assemblies 20, the corona discharge pins extend outwardly from the tubular discharge electrodes 50 in a plane parallel to the collecting electrode plate assemblies 20. With the corona discharge pins 52 so positioned, the electrostatic field distribution that cross the collecting electrode plates is smooth and uniform.

Although described and illustrated herein with reference to the preferred embodiment shown in the drawing and representing the best mode presently contemplated for carrying out the present invention, it is to be understood that many variations of the depicted embodiment may be envisioned by those skilled in the art without departing from the basic concept of the present invention. Accordingly, it is intended that the present invention be interpreted in spirit and in scope as defined by the claims appended hereto.

We claim:

1. An electrostatic precipitator comprising:

a. a housing defining a precipitator chamber therein and having a dirty gas inlet and a clean gas outlet for conveying a horizontal flow of gas to be cleaned through the precipitator chamber;

b. a collecting electrode assembly comprised of a plurality of collecting electrode plates disposed within the precipitation chamber in spaced vertical planes parallel to the direction of gas flow therethrough;

c. a discharge electrode assembly to which a voltage is applied to generate an electrostatic field comprised of a plurality of discharge electrode subassemblies disposed parallel to and alternately intermediate between collecting electrode plates, each discharge electrode subassembly supporting a plurality of spaced vertically extending discharge electrode members, each of said discharge electrode members comprising an elongated hollow tube extending along a vertically disposed longitudinal axis and having a transverse cross-section having an ellipsoidal configuration, and a plurality of corona discharge pins disposed at spaced intervals along the length of said hollow tube and extending outwardly therefrom in a plane parallel to the collecting electrode plates; and d. said hollow tube discharge electrode members disposed with the longer axis of the ellipsoidal cross-section thereof perpendicular to said collecting electrode plates and the shorter axis of the ellipsoidal cross-section thereof parallel to said collecting electrode plates.

2. An electrostatic precipitator as recited in claim 1 wherein the corona discharge pins extend outwardly from said hollow tube discharge electrode members at an acute angle with the longitudinal axis of said hollow tube of at least 45 degrees.

3. An electrostatic precipitator as recited in claim 2 wherein the corona discharge pins extend outwardly from said hollow tube discharge electrode members at an acute angle with the longitudinal axis of said hollow tube of at least 45 degrees and not more than 60 degrees.

4. An electrostatic precipitator as recited in claim 3 wherein the corona discharge pins extend outwardly and downwardly from said hollow tube discharge electrode members at an acute angle with the longitudinal axis of said hollow tube of at least 45 degrees and not more than 60 degrees.

5. A discharge electrode for an electrostatic precipitator comprising:

a. an elongated hollow tubular member extending along a longitudinal axis and having a transverse cross-section having an ellipsoidal configuration; and b. a plurality of elongated corona discharge pins disposed at spaced intervals along the length of said elongated tubular member and extending outwardly therefrom at an acute angle with respect to the longitudinal axis of said elongated tubular member in a plane through the shorter axis of the ellipsoidal cross-section of said elongated tubular member.

6. A discharge electrode as recited in claim 5 wherein said corona discharge pins extending outwardly from said elongated tubular member at an acute angle with the longitudinal axis of said elongated tubular member of at least 45 degrees and not more than 60 degrees.

* * * * *